United States Patent [19]

Kennedy et al.

[11] Patent Number: 4,642,066

[45] Date of Patent: Feb. 10, 1987

[54] TOY VEHICLE LAUNCHER AND SOUND GENERATOR

[76] Inventors: Melvin R. Kennedy, 22 Lynn Ct., Hampton Bays, N.Y. 11946; Dietmar Nagel, 147 South Rd., Chester, N.J. 07930; Avi Arad, Minuteman Hill, Westport, Conn. 06880

[21] Appl. No.: 739,154

[22] Filed: May 30, 1985

[51] Int. Cl.[4] ..... A63H 5/00

[52] U.S. Cl. ..... 446/420; 446/409; 446/430; 124/37; 124/48; 124/26

[58] Field of Search ..... 446/429, 430, 420, 409, 446/418; 124/26, 48, 17, 16, 41 R, 51 R, 31, 37

[56] References Cited

U.S. PATENT DOCUMENTS

| | | | |
|---|---|---|---|
| 477,764 | 6/1892 | Mercer | 124/37 X |
| 2,633,119 | 3/1953 | Bauderer et al. | 124/37 X |
| 2,837,078 | 6/1958 | Daniel | 124/48 X |
| 2,922,412 | 1/1960 | Hosbach, Jr. | 124/48 X |
| 3,877,169 | 4/1975 | Munday et al. | 446/430 |
| 3,895,459 | 7/1975 | Morrison et al. | 446/430 |
| 3,908,303 | 9/1975 | McKay et al. | 446/430 |
| 4,016,674 | 4/1977 | Resnick et al. | 446/429 X |
| 4,267,661 | 5/1981 | Hanson | 446/430 |

FOREIGN PATENT DOCUMENTS

| | | | |
|---|---|---|---|
| 28910 | 6/1964 | German Democratic Rep. | 446/420 |

*Primary Examiner*—Mickey Yu

*Attorney, Agent, or Firm*—Kenyon & Kenyon

[57] ABSTRACT

An apparatus for launching toy vehicles utilizes a hexagonal magazine, rotatably mounted on a frame, having a plurality of pairs of open-ended chambers therein. The magazine is rotated to align a pair of chambers having toy vehicles therein with, respectively, a first and a second ram disposed on the frame, positioned, by an arm, against the urging of springs, back from the openings of the chambers, and locked in place. The rams are selectively, independently releasable, upon forward motion of the arm, which simultaneously engenders a revving sound, to enter corresponding chambers and launch toy vehicles therefrom.

17 Claims, 9 Drawing Figures

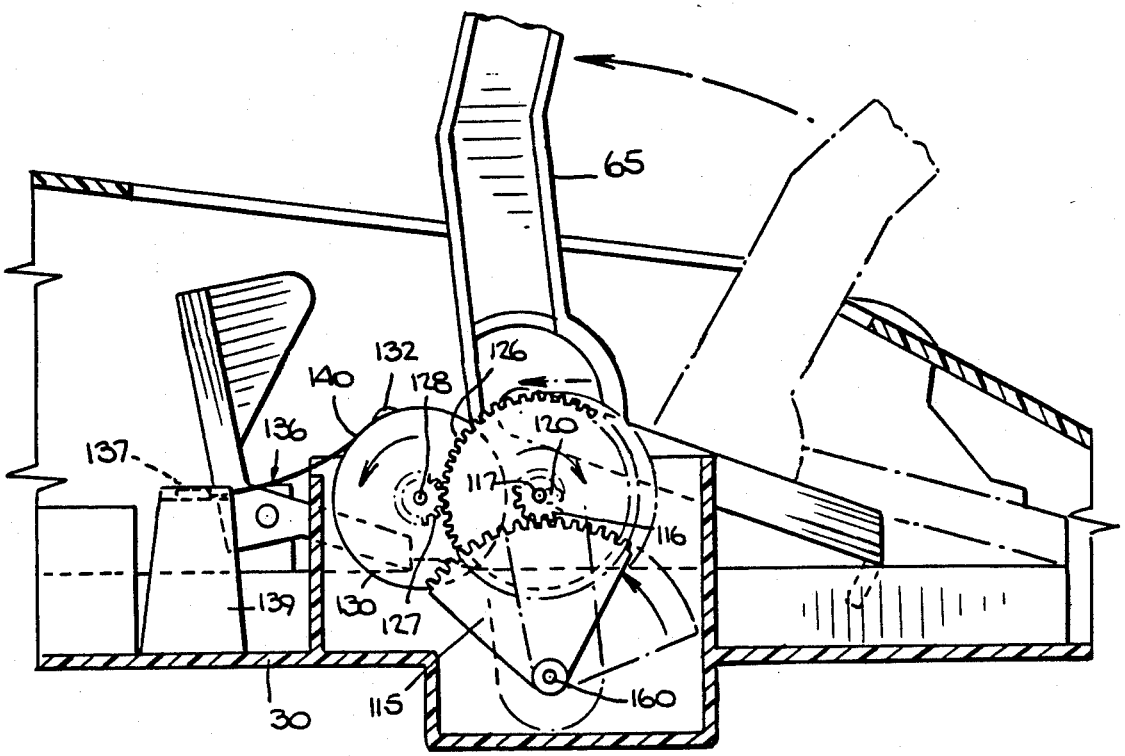
Fig. 7A.
Fig. 7B.
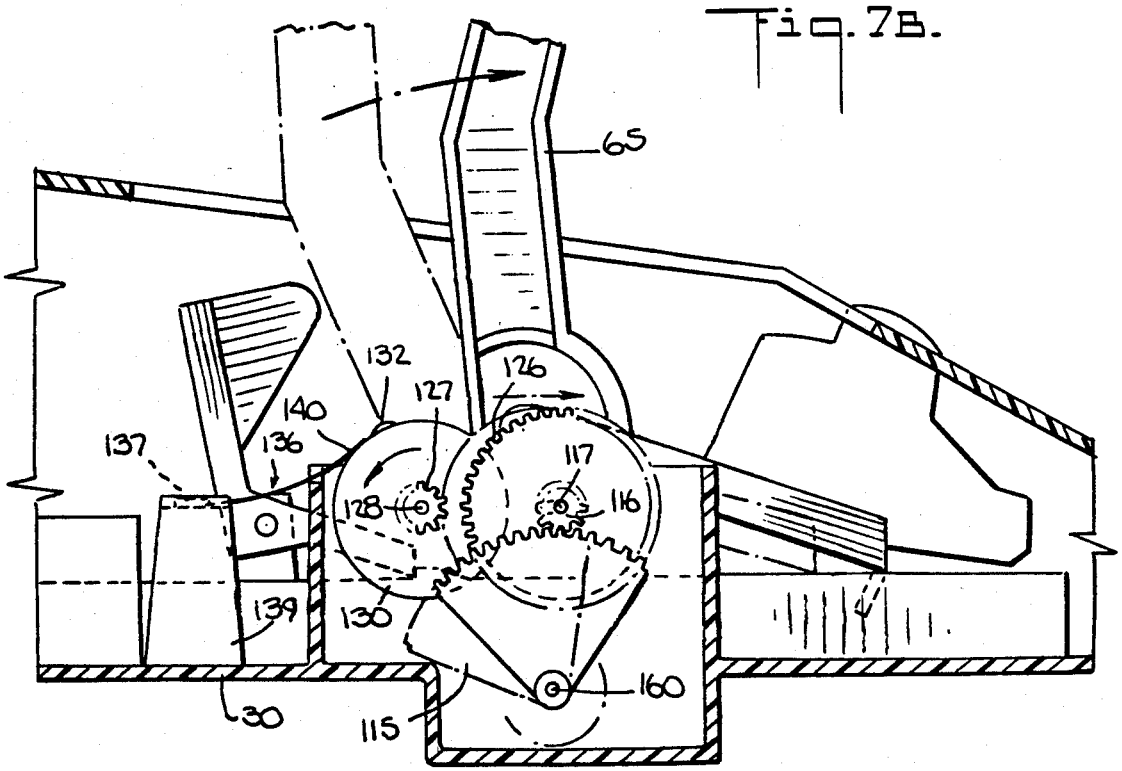

TOY VEHICLE LAUNCHER AND SOUND GENERATOR

BACKGROUND OF THE INVENTION

The present invention relates generally to toys, and more particularly to an apparatus for launching toy vehicles.

Children find entertainment in imitating the activities of adults. Accordingly, play with toy vehicles is a perennial favorite amongst young people.

The experience is enhanced to the extent that the toy apparatus simulates an actual working mechanism. Thus, toy vehicles that exhibit movement, particularly rapid movement, without manual manipulation are extremely appealing to a child. Engine sounds accompanying a toy vehicle further contribute to the realism, and consequently to the enjoyment of the occasion. Additional pleasure is derived by a child from the ability to regulate or control various aspects of a toy vehicle by operating buttons, switches, levers, handles, and the like.

Thus, there is a need for a toy apparatus that embodies each of these features that children find attractive.

SUMMARY OF THE INVENTION

The present invention entails an apparatus for launching objects, particularly, toy vehicles. The apparatus comprises a frame, and a magazine, removably disposed on the frame, having a chamber therein. The chamber in the magazine possesses a first and a second opening, wherein the first opening communicates with the second. A first ram, disposed on the frame, is movable between a first and a second position, the first ram being clear of the magazine in the first position. The magazine is positionable on the frame to align the chamber therein with the first ram so that the first ram in moving from the first to the second position passes into the chamber through the first opening thereof. A means is employed for moving the first ram between the first and second positions.

One embodiment of the invention further comprises a second ram, disposed on the frame, movable between a third and a fourth position, the second ram being clear of the magazine in the third position. In this embodiment, the magazine comprises a plurality of chambers, each having a first opening therein communicating with a second opening therein. The magazine is positionable on the frame to simultaneously align a first and a second of the chambers with, respectively, the first and second rams so that the first ram in moving from the first to the second position passes into the first chamber through the first opening thereof, and the second ram in moving from the third to the fourth position passes into the second chamber through the first opening thereof. Means is employed for moving the first and second rams between, respectively, the first and second position, and the third and fourth position.

In a preferred embodiment of the invention the means for moving the first and second rams comprises an arm, pivotally disposed on the frame, movable between a fifth and a sixth position. Additionally, means, coupled to the arm, is utilized for transmitting motion of the arm to the first and second rams so that movement of the arm from the sixth to the fifth position engenders movement of the first ram from the second to the first position, and movement of the second ram from the fourth to the third position, and so that movement of the arm from the fifth position to the sixth position does not engender movement of the first and second rams. The means for moving the first and second ram further comprises means, affixed to the frame and the first ram, for urging the first ram from the first position to the second position; and, means, affixed to the frame and the second ram, for urging the second ram from the third position to the fourth position.

A preferred embodiment of the invention also includes means, disposed on the frame, for selectively fixing and releasing the first ram in the first position; means, disposed on the frame, for selectively fixing and releasing the second ram in the third position; means, disposed on the frame and on the first and second rams, for fixing the first and second rams in, respectively, the first and third positions, and for releasing the first and second rams in, respectively, the first and third positions upon movement of the arm to a predetermined position; and, means, coupled to the arm, for generating, in response to movement of the arm, a revving sound. The magazine, in a preferred embodiment of the invention, is rotatably disposed on the frame, and configured so that the first and second chambers are simultaneously alignable with, respectively, the first and second rams by rotation of the magazine.

A preferred embodiment of the invention further comprises the following features: means, disposed on the frame, for fixing the first and second rams in, respectively, the first and third position when the magazine is not disposed on the frame; means, disposed on the magazine and the frame, for visually aligning the first and second chambers with, respectively, the first and second rams; means, disposed on the magazine and the frame, for securing the first and second chambers in alignment with, respectively, the first and second rams; and, means, coupled to the first and second chambers, for securing therewithin objects to be launched therefrom.

BRIEF DESCRIPTION OF THE DRAWINGS

Identical numerals in different figures refer to identical elements.

FIG. 3 is a perspective view of a portion of the preferred embodiment of the present invention wherein the cover is removed, the magazine is in place, and the rams are withdrawn.

FIG. 6 is a sectional view of the preferred embodiment of the present invention wherein the cover is in place, the magazine is in place, and one ram is extended.

FIG. *7a* is a sectional view of the revving mechanism of the preferred embodiment of the present invention wherein the handle is moving forward.

FIG. 7*b* is a sectional view of the revving mechanism of the preferred embodiment of the present invention wherein the handle is moving backward.

Figure 8:
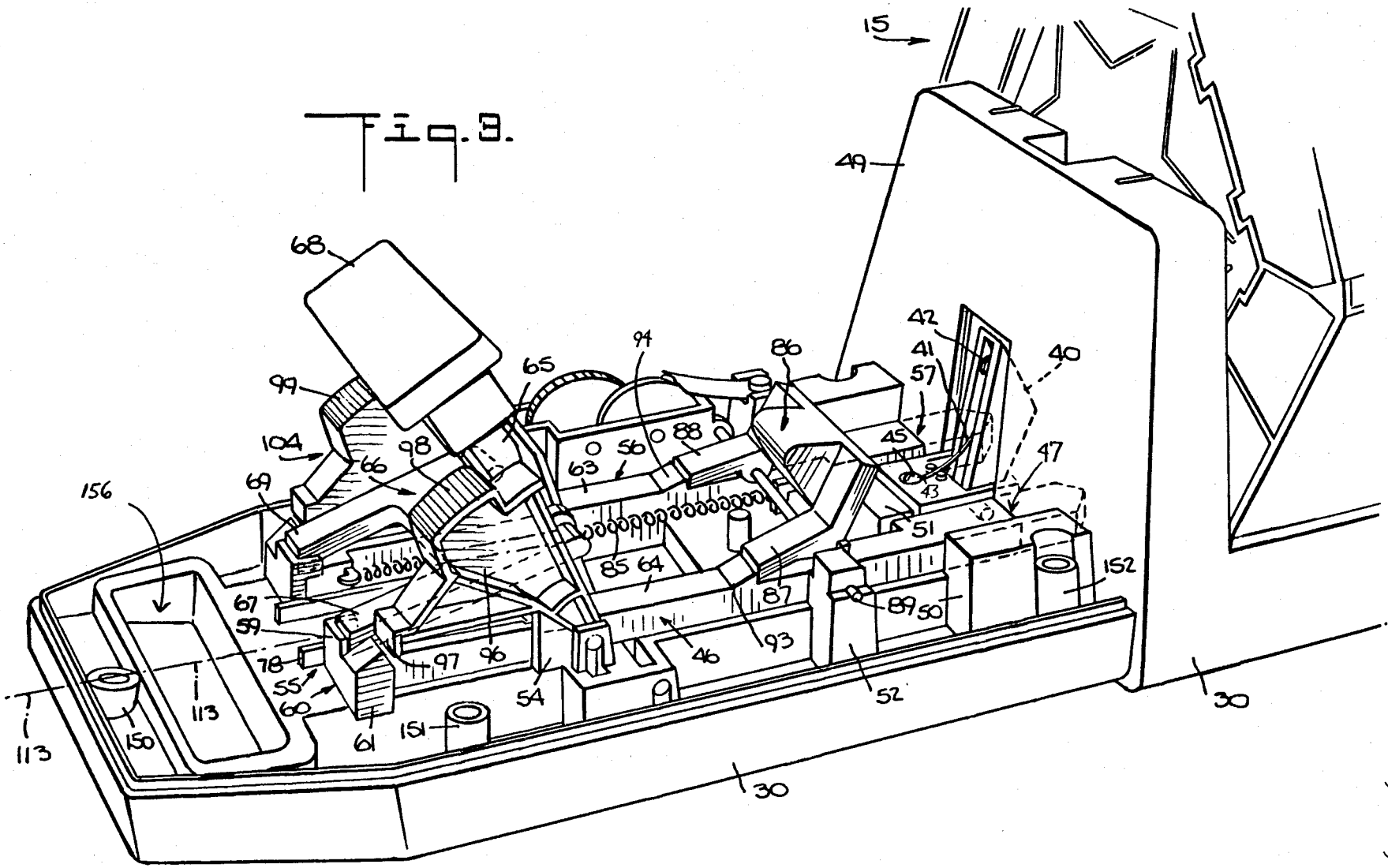

FIG. 8 is a perspective view of the preferred embodiment of the present invention wherein the cover and the magazine are in place.

DESCRIPTION OF THE PREFERRED EMBODIMENTS

Figure 1:
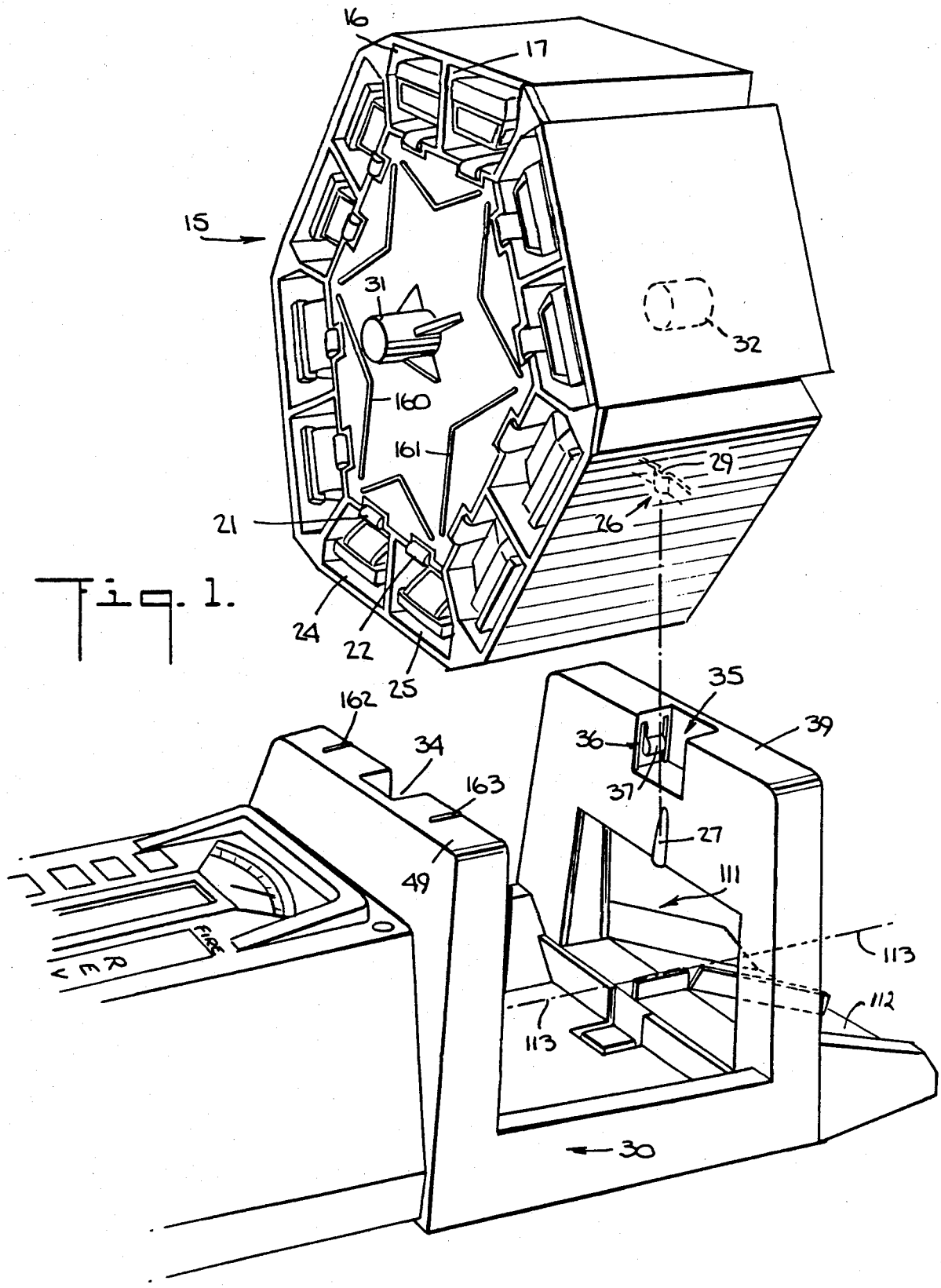
FIG. 1 is a perspective view of a portion of the preferred embodiment of the present invention wherein the magazine is removed, and the cover is in place.
Figure 2:
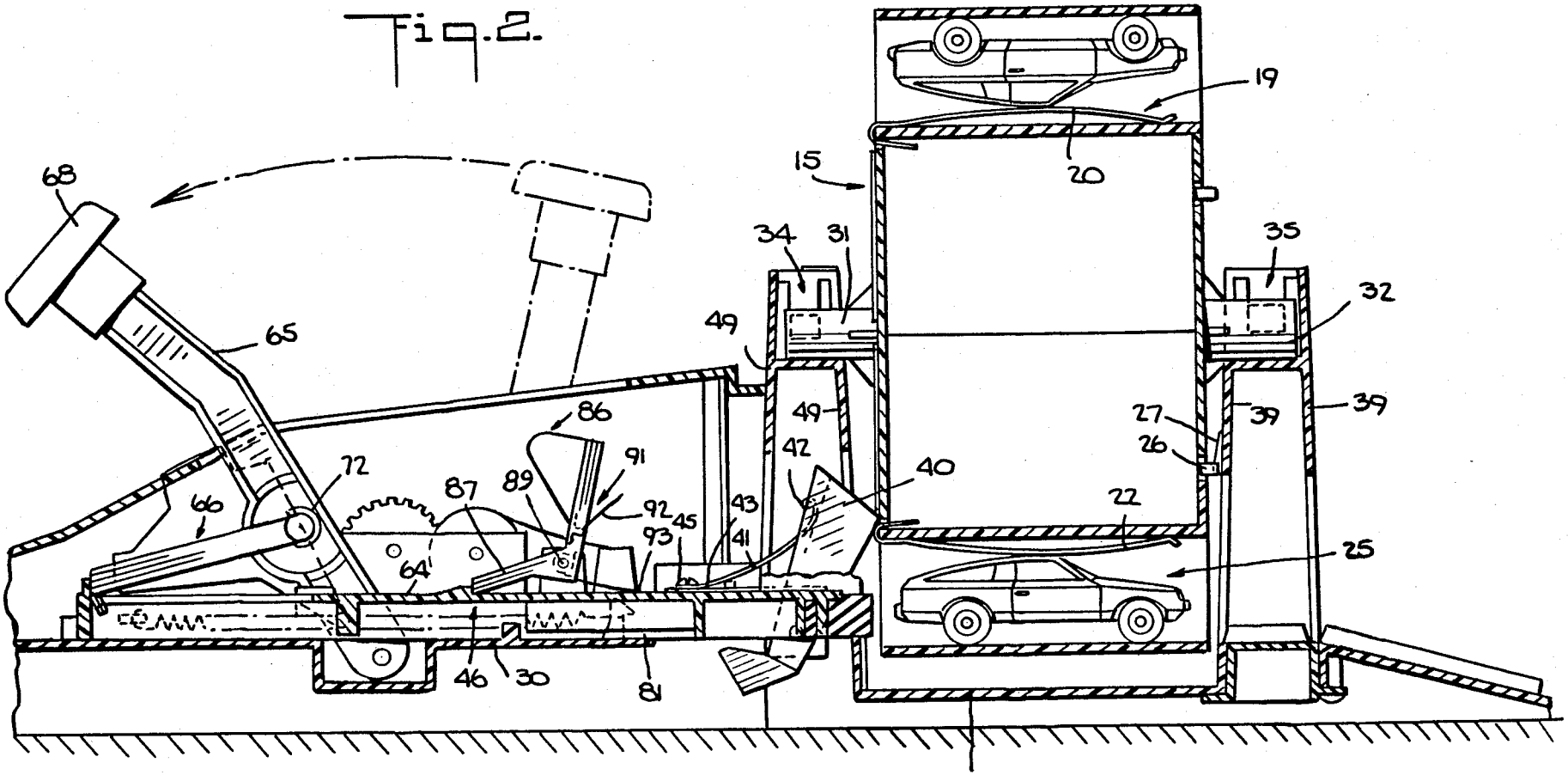
FIG. 2 is a sectional view of the preferred embodiment of the present invention wherein the cover is in place, the magazine is in place, and the rams are withdrawn.

The present invention entails an apparatus for launching toy vehicles. Referring to FIG. 1, a hexagonal magazine 15 comprises 12 chambers, such as chambers 16 and 17. The chambers are configured to receive toy vehicles which are ultimately ejected therefrom. Referring to FIG. 2, a clip 19 is disposed in each chamber with the arched portion 20 extending inward so as to hold a toy vehicle in the chamber. Referring to FIGS. 1 and 2, the clips, such as 21 and 22, are disposed so that when the toy vehicles are in their upright positions in the lowermost chambers 24 and 25, the clips 21 and 22 press the tops of the vehicles downward against the floor of the chambers 24 and 25. A receiving member 26 is disposed on the front face of the hexagonal magazine 15 above and midway between the lowermost chambers 24 and 25. A projection 27 is disposed to fit into a receptacle 29 in the center of the receiving member 26. Such a receiving member 26 is similarly disposed relative to each of the other five pairs of chambers. The hexagonal magazine 15 is removably disposable on a frame 30. Shafts 31 and 32 are configured to be seated, respectively, in receptacles 34 and 35. A securing member 36 is resiliently disposed on each of the sides of the receptacles 34 and 35 which is parallel to the longitudinal axis of the shafts 31 and 32. The securing member 36 is configured to compliantly give way as a shaft is inserted into a receptacle; and, to spring back towards its original position once the shaft has passed beneath an arcuate projection 37. The projection 37 secures a shaft beneath it. In this fashion the shafts 31 and 32 are fixed in the receptacles 34 and 35. The securing member 36 gives way when upward force is applied to the hexagonal magazine 15, releasing the shafts 31 and 32 from, respectively, the receptacles 34 and 35. When the hexagonal magazine 15 is disposed on the frame 30, and the lowermost chambers 24 and 25 are horizontal, the projection 27 is held by the receptacle 29 of the receiving member 26, fixing the horizontal magazine 15 in this position. Rotating the horizontal magazine 15 about the shafts 31 and 32 disposed, respectively, in the receptacles 34 and 35 breaks the hold of the receiving member 26 on the projection 27. When another pair of chambers assumes the lowermost horizontal position the projection 27 snaps into the receptacle of a corresponding receiving member, and the hexagonal magazine 15 is fixed in the new position. In this fashion, upon rotation of the hexagonal magazine 15, as each pair of chambers assumes the lowermost horizontal position, the projection 27 snaps into the receptacle on a corresponding receiving member, fixing the horizontal magazine 15 in place, until further rotation breaks the engagement. Referring to FIGS. 2 and 3, to ensure such engagement, the hexagonal magazine 15 is pressed toward a first wall 39 of the frame 30 by a forcing member 40 which retracts upon insertion of the horizontal magazine 15 into the frame 30 and resiliently pushes forward against the magazine 15. The resiliency of the forcing member 40 is supplied by a pair of flexible wires 41. A first pair of ends 42 of the wires 41 is freely disposed in a groove in the back of the forcing member 40. A second pair of ends 43 of the wires 41 is affixed via a screw 45 to the frame 30. When the forcing member 40 is pushed backward upon insertion of the hexagonal magazine 15 into the frame 30, the pair of wires 41 flexes, and the first pair of ends 42 move upward in the groove in the back of the forcing member 40. The forcing member 40 is, accordingly, urged forward against the hexagonal magazine 15.

Referring to FIG. 3, a first ram 46 is disposed on the frame 30 to move back and forth along its longitudinal axis through an opening 47 in a second wall 49. The first ram 46 is constrained in its path by the opening 47, a block 50, a block 51, a block 52, a guide 54, and a guide 55. A second ram 56 is similarly disposed and constrained to move back and forth through a second opening 57 in the second wall 49.

A projection 59 is disposed on a first end 60 of the first ram 46. A block 61 is disposed on a side of the first ram 46 at the first end 60. A projection 93 is disposed on an upper surface 64 of the first ram 46, and a projection 94 is disposed on an upper surface 63 of the second ram 56. An arm 65, having a handle 68 on an end thereof, is pivotally mounted on the frame 30. Referring to FIGS. 2, 3, 4 and 5, a pushing member 66, having first and second arms 67 and 69, is pivotally coupled, via a first shaft 70 and a second similar shaft (not shown) to the arm 65. A first receptacle 72 and a second similar receptacle (not shown), mounted on the arm 65, receive and hold, respectively, the first and second shafts of the pushing member 66. Referring to FIGS. 3 and 5, a spring 74 is coupled between a projection 76 affixed to the frame 30 and a projection 77 on the first end 60 of the first ram 46. The spring 74 is extended when the first end 60 of the first ram 46 is proximate an end 78 of the guide 55, and urges the first ram 46 forward through the first opening 47. The first arm 67 of the pushing member 66 is disposed on the upper surface 64 of the first ram 46, with a finger 18 slidably engaged in a slot 23 on the upper surface 64. When the first ram 46 extends through the first opening 47, in response to forward urging of the spring 74, the first ram 46 may be drawn backward by pulling the arm 65, via the handle 68, backward. The first arm 67 of the pushing member 66 thus contacts the projection 59 and pushes the first ram 46 backward. Referring to FIGS. 5 and 6, the first ram 46 is substantially hollow, and includes a projection 79, a projection 81, and a lateral wall 82, each affixed to the upper surface 64. A projection 80 affixed to the frame 30 is disposed to block the projection 79 as the first ram 46 is urged forward by the spring 74, and to block the projection 81 as the first ram 46 is withdrawn by the arm 65. Referring to FIG. 3, a release member 86, having a first arm 87 and a second arm 88 is pivotally mounted, via a shaft 89, on the frame 30. Referring to FIGS. 2 and 3, a flexible wire 91 is wrapped around the shaft 89 with a first end 92 positioned between two posts on the surface of the release member 86, and a second end 93 positioned between two posts on the second block 51. In this fashion, the flexible wire 91 urges the first and second arms 87 and 88 of the release member 86 against, respectively, the upper surface 64 of the first ram 46, and the upper surface 63 of the second ram 56.

Figure 4:
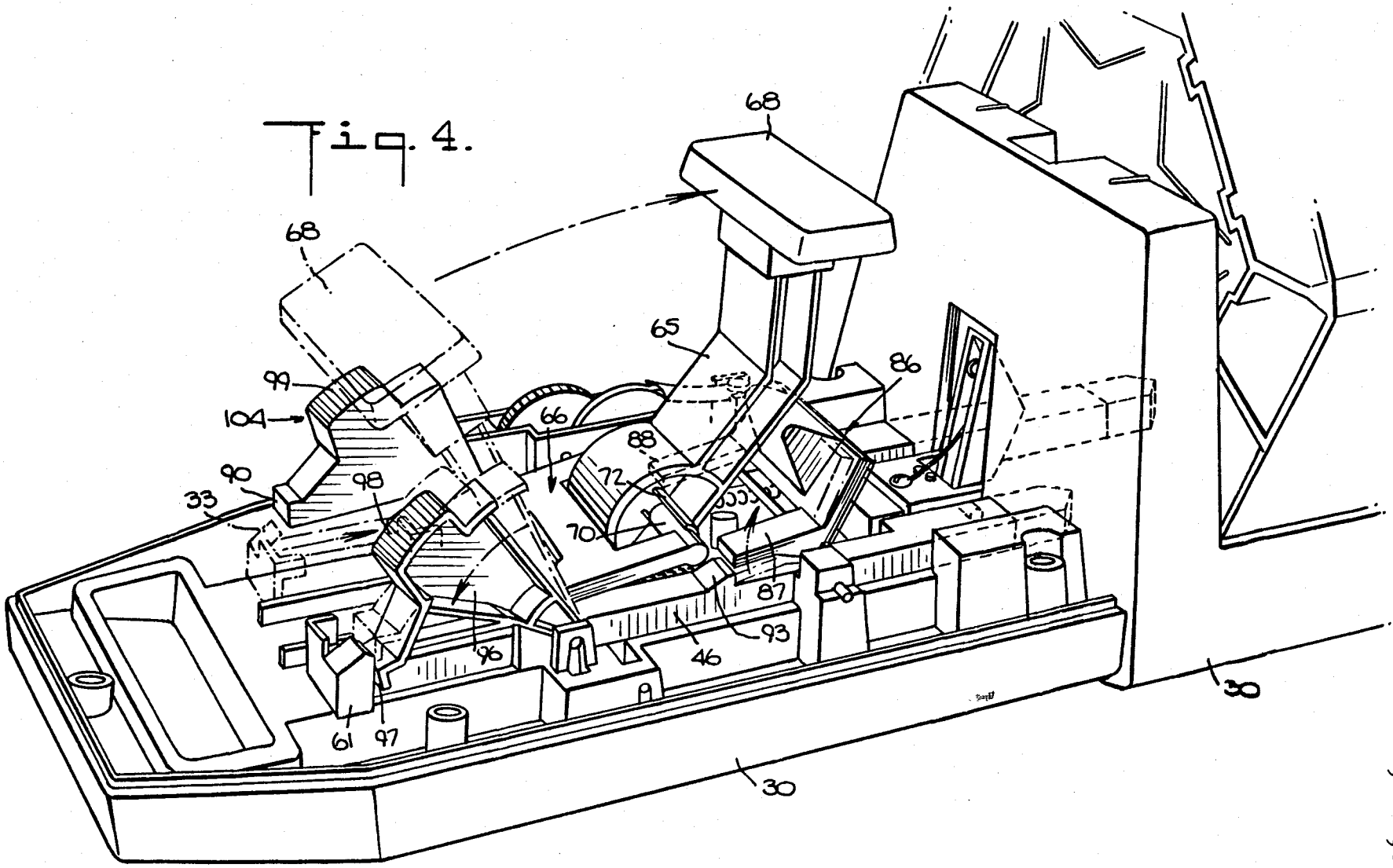
FIG. 4 is a perspective view of a portion of the preferred embodiment of the present invention wherein the cover is removed, the magazine is in place, and one ram is extended.
Figure 5:
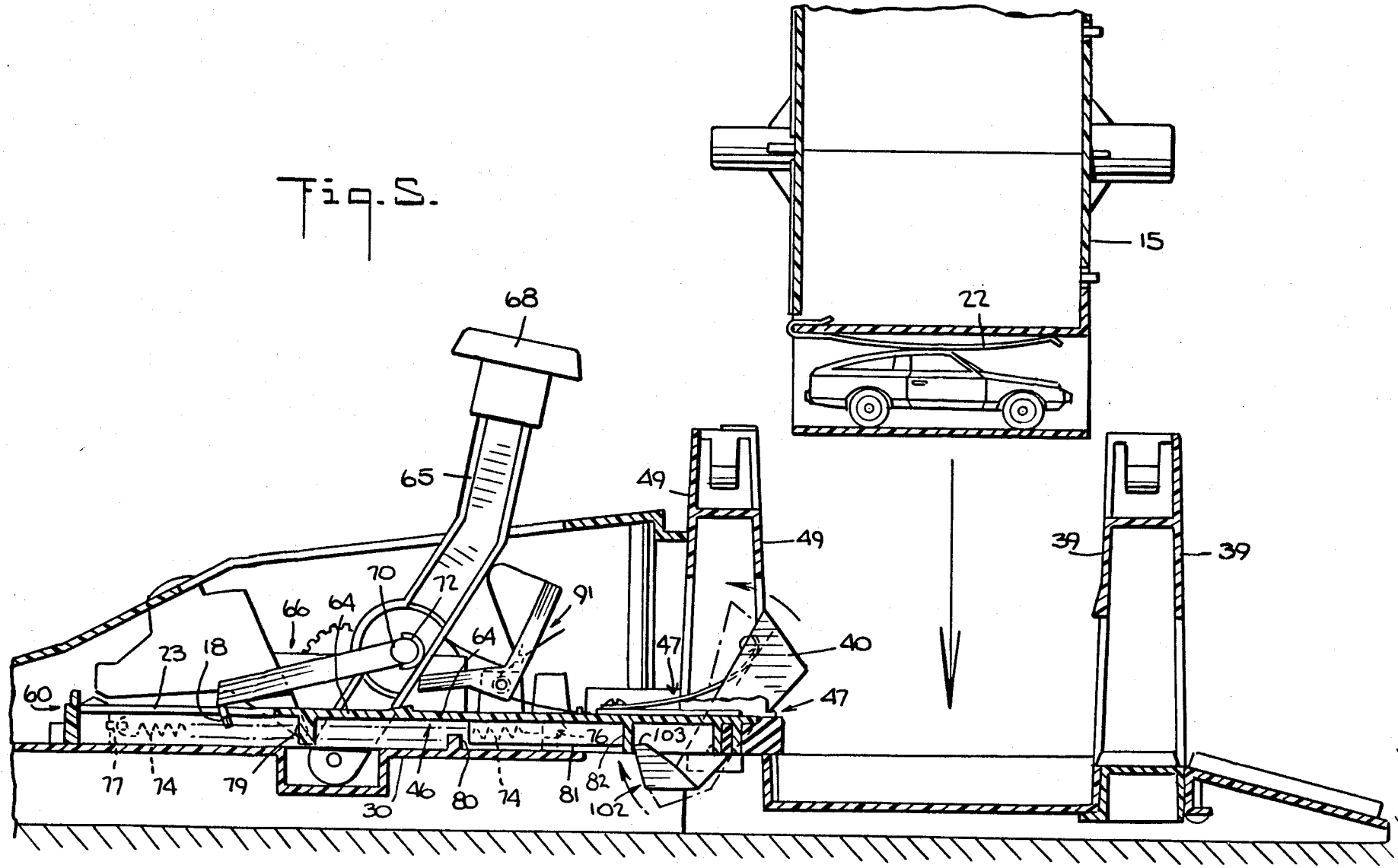
FIG. 5 is a sectional view of the preferred embodiment of the present invention wherein the cover is in place, the magazine is removed, and the rams are withdrawn.
Figure 8:
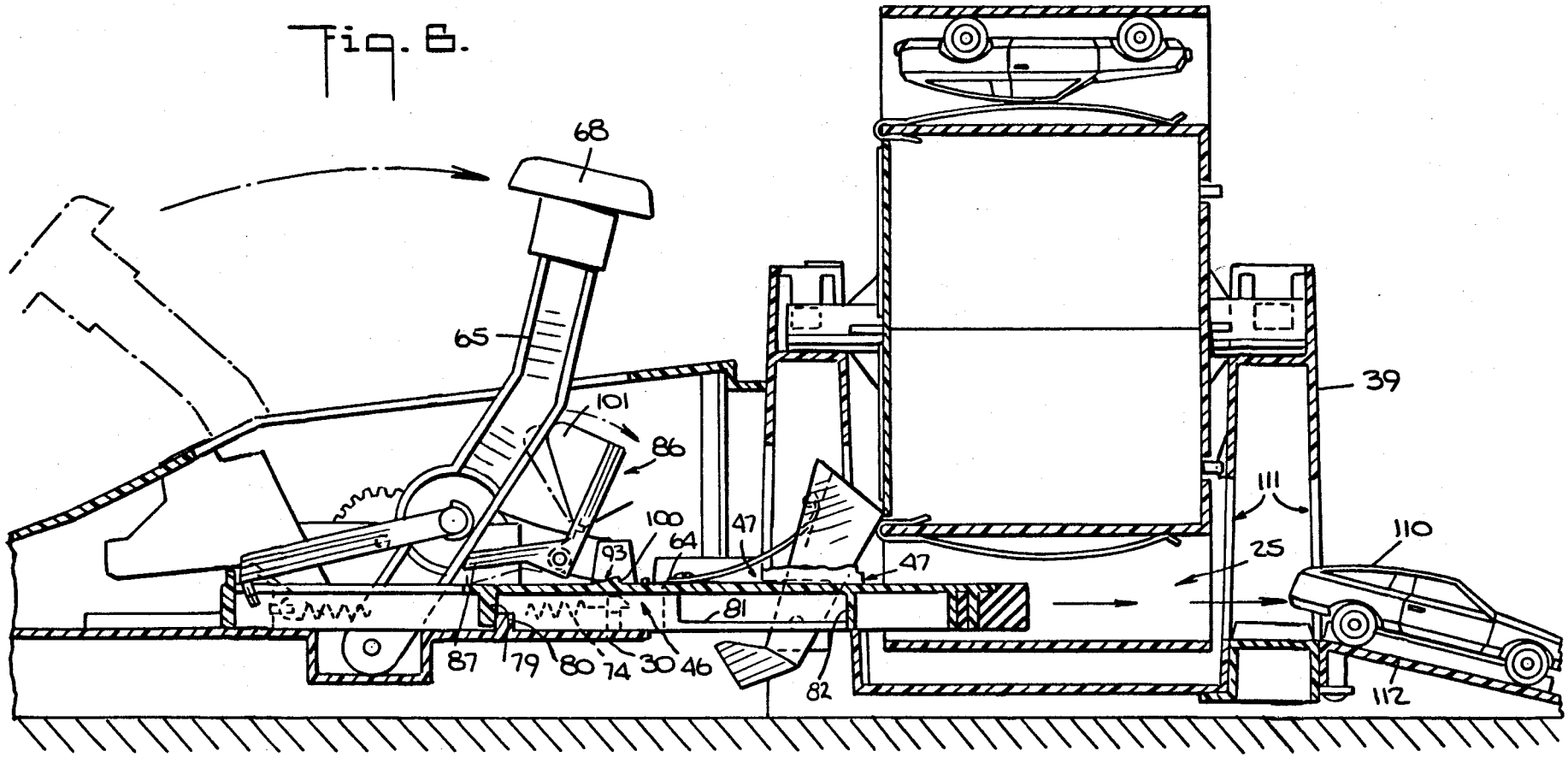
Figure 8:
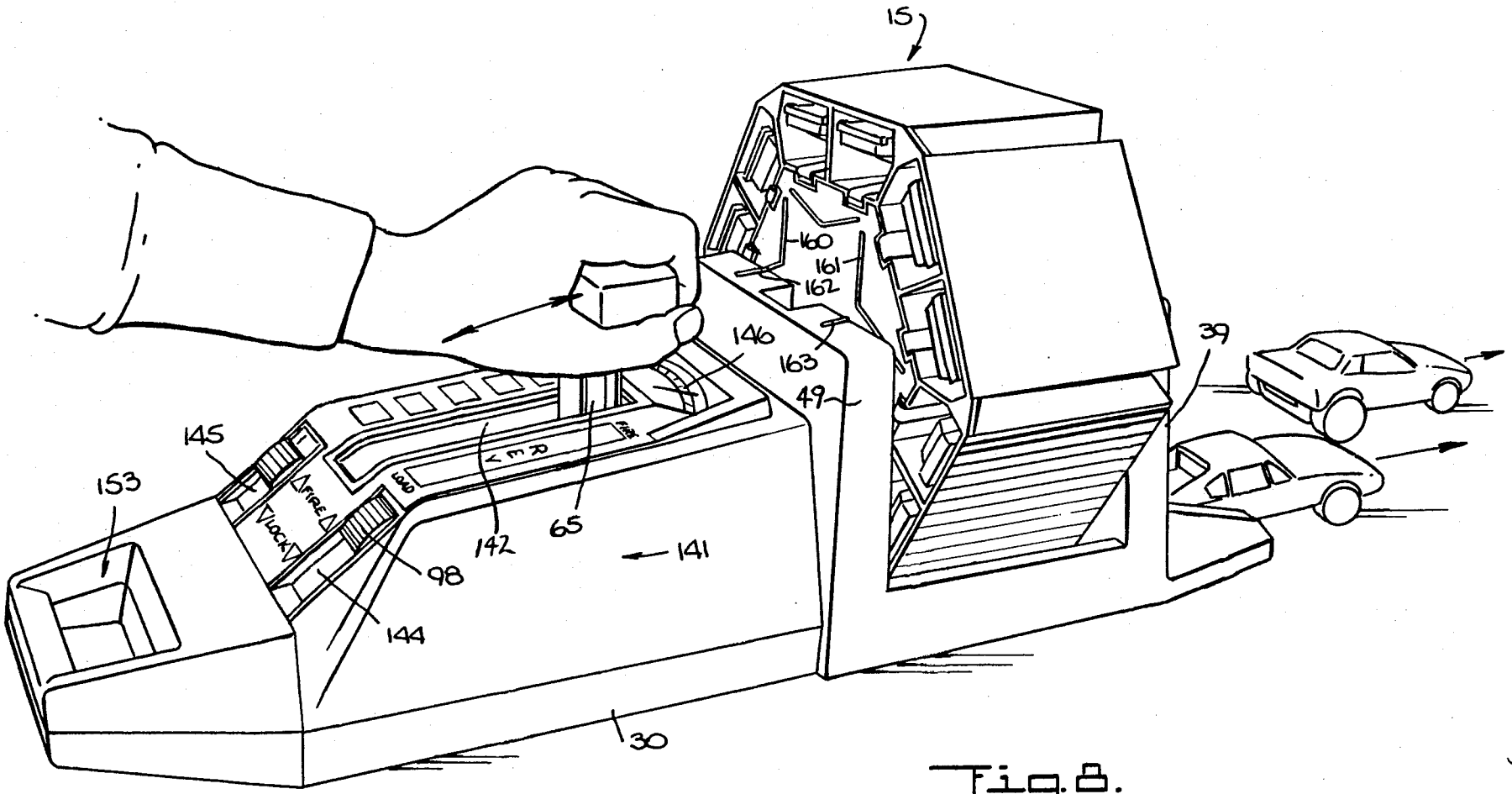

Referring to FIG. 4, a first stop member 96 is pivotally disposed on the frame 30. When the first ram 46 is drawn backward, the first stop member 96 may be rotated downward so that a face 97 of the stop member 96 is interposed before the block 61, preventing the first ram 46 from moving forward. A serrated face 98 of the first stop member 96 is configured so that an operator's finger applied thereto can readily rotate the first stop member 96 to engage the block 61 with the face 97 by a downward movement, or to disengage the face 97 from the block 61 by an upward movement. Referring to FIG. 3, the projection 93 is fixedly disposed on the upper surface 64 of the first ram 46 so that when the face 97 of the stop member 96 engages the block 61, the first arm 87 of the release member 86 resting upon the upper surface 64 of the first ram 46 is proximate the projection 93 and blocks its path when the first ram 46 moves forward. Accordingly, when the arm 87 of the release member 86 is resting, in its natural position, on the upper surface 64 of the first ram 46, and the stop member 96 is pushed upward, disengaging the face 97 from the block 61, the first ram 46 is prevented, due to blockage of the projection 93 by the first arm 87, from moving through the first opening 47.

Referring to FIG. 6, when the first ram 46 extends through the first opening 47 with the forward edge 100 of the projection 93 between the end of the first arm 87 of the release member 86 and the first opening 47, the first ram 46 can be drawn backward without obstruction by the first arm 87 of the release member 86; since, the release member 86 gives way as the projection 93 passes beneath the first arm 87. When the arm 65 is pushed forward via the handle 68, the arm 65 contacts a mound 101 on the release member 86, rotating the release member 86 forward, lifting the first arm 87 above the level of the projection 93.

Referring to FIG. 5, an arm 102 is disposed on the forcing member 40 so that when the first ram 46 is in the withdrawn position and the forcing member 40 extends forward, in the absence of the hexagonal magazine 15, an end 103 of the arm 102 is disposed before the lateral wall 82 of the first ram 46. In this fashion, the first ram 46 is prevented from moving through the first opening 47 when the hexagonal magazine 15 is removed from between the first wall 39 and the second wall 49. When the first ram 46 is extended through the first opening 47, and the forcing member 40 is forward in the absence of the hexagonal magazine 15, the first ram 46 can be drawn backward without obstruction by the end 103 of the arm 102; since, the end 103 upon contact with the retreating lateral wall 82 gives way, rotating downward.

Referring to FIGS. 1 and 6, when the hexagonal magazine 15 is disposed with the shafts 31 and 32 in, respectively, the receptacles 34 and 35, and with the lowermost chamber 25 horizontal, the first ram 46 upon extension through the first opening 47 projects substantially into the chamber 25. A toy vehicle 110 in the chamber 25 is, accordingly, pushed forward out of the chamber 25, through an opening 111 in the first wall 39, and down a ramp 112 affixed to the lower front of the first wall 39.

Referring to FIGS. 1 and 3, when the shafts 31 and 32 of the hexagonal magazine 15 are disposed in, respectively, the receptacles 34 and 35, and the lowermost chamber 25 is horizontal, the above described features of the present invention are symmetric about a central longitudinal axis 113. Accordingly, the features of the invention to the left of the central longitudinal axis 113, when facing forward, not described above are replicas of those elaborated upon above (with one exception described below) and need not be further detailed.

Referring to FIG. *7a*, the non-symmetric feature entails a mechanism for generating a revving sound. A gear 115 is affixed to one end of a shaft 160 to which the arm 65 is attached; the shaft 160 is rotatably mounted in the frame 30. A second gear 116 having a small radius relative to that of the gear 115 is affixed to a shaft 117 which is rotatably mounted in the frame 30. The shaft 117 is disposed so the the teeth of the gear 116 are emeshed with the teeth of the gear 115. A first end of the shaft 117 is disposed in an opening 120 having a horizontal width greater than the diameter of the shaft 117. The vertical height of the opening 120 is just sufficiently larger than the diameter of this shaft 117 to permit unrestricted movement of the shaft 117 in the horizontal direction without vertical movement that would disengage the teeth of the gear 116 from those of the gear 115. A second end (not shown) of the shaft 117 is disposed in a second opening (not shown) having dimensions similar to those of the opening 120. A gear 126, having a large radius relative to that of the gear 116, is affixed to the shaft 117. A gear 127, having a small radius relative to that of the gear 126, is affixed to a shaft 128 rotatably mounted in the frame 30. The gear 127 is disposed so that the teeth thereof engage those of the gear 126 when the ends of the shaft 117 are forward, respectively, in their openings. Referring to FIG. *7b*, when the ends of the shaft 117 are rearward, respectively, in their openings the teeth of the gear 126 are disengaged from those of the gear 127. A disk 130 is affixed to the shaft 128. The disk 130 comprises a plastic disk having an arcuate projection 132 on the circumference. The disk 130 further comprises a metal disk having a rough circumferential surface. The metal disk is adjacent to, and of the same diameter as the plastic disk. A flexible strip 136, preferably comprising plastic, is disposed with a first end 137 affixed to a post 139 on the frame 30, and a second end 140 freely flexed against the circumferential surface of the disk 130.

Referring to FIG. *7a*, when the arm 65, via the handle 68, is pushed forward, the shaft 160 is rotated forward. The gear 115, whose teeth are emeshed with those of the gear 116, rotates forward, rotating the gear 116, and the gear 126, and pushing the gear 116 forward so that the ends of the shaft 117 are forward, respectively, in their openings. With the shaft 117 in this position, the teeth of the rotating gear 126 are in engagement with those of the gear 127. Accordingly, the gear 127 and the disk 130 are rotated forward. Due to the gear ratios involved a single forward motion of the arm 65 engenders many rotations of the disk 130. As the disk 130 rotates the arcuate projection 132 passes beneath the strip 136, forcing the strip 136 upward. The strip 136, after the projection 132 has passed thereunder, flexes back in contact with the rough circumferential surface of the metal disk. As the disk 130 rotates, the periodic lifting of the strip 136 by the projection 132 and the abrasion of the rough circumferential surface of the metal disk on the strip 136 result in a vibration and scratching of the strip 136 that sounds similar to the revving of an engine. When the disk 130 is rotating, if forward motion of the arm 65 ceases, the forward rotating gear 127 rotates the gear 126 backward, rotating the gear 116 backward along the teeth of the gear 115. The gear 126 is thus moved backward out of engagement with the gear 127, permitting unimpeded rotation of the disk 130. Accordingly, after the arm 65 has been moved forward briskly, the disk 130 continues to rotate, producing the revving sound, owing to the momentum of the relatively heavy metal disk. Referring to FIG. 7*b*, when the arm 65 is drawn backward, the shaft 160 rotates backward. The gear 115, whose teeth are emeshed with those of the gear 116, rotates backward, pushing the gear 116 backward so that the ends of the shaft 117 are rearward, respectively, in their openings. With the shaft 117 in this position, the teeth of the gear 126 are disengaged from those of the gear 127. Accordingly, the forward rotation of the disk 130 is not affected by backward motion of the arm 65.

Referring to FIGS. 3 and 8, a cover 141 is configured to enclose the mechanisms of the present invention rearward of the second wall 49. The cover 141 is attached to the frame 30 via cylindrical projections within the cover 141 (not shown) which fit within hollow cylindrical receptacles such as 150, 151, and 152 on the frame 30. The cylindrical projections and the cylindrical receptacles comprise screw holes into which screws are inserted, through the bottom of the frame 30, to affix the cover 141 to the frame 30. A longitudinal opening 142 accommodates the arm 65 and its motions. The rearmost position of the arm 65, in which the first end 60 of the first ram 46 is proximate the end 78 of the guide 55, is designated LOAD on the cover 141. Referring to FIGS. 4 and 8, the forwardmost position of the arm 65, in which the arm 87 of the release member 86 is elevated above the projection 93, is designated FIRE on the cover 141. The region intermediary to the FIRE and LOAD zones is designated REV. An opening 144 in the cover 141 is disposed so that the serrated face 98 of the stop member 96 projects therethrough, and is movable therein between a downward LOCK position wherein the face 97 is interposed before the block 61 preventing forward motion of the ram 46, and an upward FIRE position wherein the face 97 is clear of the forward path of the block 61. An opening 145 is similarly disposed relative to the symmetric stop member. Other dashboard indicators may be represented on the cover 141 to enhance realism. For example, a speedometer 146 may be depicted forward of the longitudinal opening 142, and a digital clock, an oil symbol, a temperature symbol, and a battery symbol may be depicted in areas to the left side of the longitudinal opening 142.

The operation of the present invention is described here below. Referring to FIGS. 1, 3, and 5, toy vehicles are placed in the chambers of the hexagonal magazine 15 facing the side of the hexagonal magazine 15 on which the receiving member 26 is disposed. A clip, such as clip 22, secures the toy vehicle within the chamber. If the first ram 46 and the second ram 56 are not already withdrawn through, respectively, the first opening 47 and the second opening 57 in the second wall 49, this is done, to clear the space between the first wall 39 and the second wall 49, by drawing the arm 65, via the handle 68, backward. In so doing, the first and second arms 87 and 88 of the release member 86 are depressed by the wire 91 against the upper surfaces 64 and 63 of, respectively, the first and second rams 46 and 56, blocking, respectively, the projections 93 and 94. The first and second rams 46 and 56 are thus held withdrawn. Referring to FIG. 2, the hexagonal magazine 15 is disposed between the first wall 39 and the second wall 49 with the shafts 31 and 32 disposed, respectively, in the receptacles 34 and 35. The forcing member 40 urges the hexagonal magazine 15 forward towards the first wall 39. The hexagonal magazine 15 is rotated until a chamber carrying a toy vehicle is horizontal and occupies the lowermost position on the hexagonal magazine 15. Referring to FIG. 1, the marks 160 and 161 on the face of the hexagonal magazine 15, when aligned, respectively, with the marks 162 and 163 on the top of the wall 49, indicate that the lowermost chambers of the hexagonal magazine 15 are horizontal. Further, the projection 27 snaps into the receptacle 29 of the receiving member 26 when the lowermost chambers are horizontal.

A toy vehicle in the lowermost chamber 24 or the lowermost chamber 25 or those in both may be launched from their respective chambers through the opening 111 in the first wall 39 and down the ramp 112. Referring also to FIGS. 4 and 8, to launch the toy vehicle in the chamber 24, but not that in the chamber 25, the serrated face 99 of the stop member 104 is pushed into the upward FIRE position designated on the cover 141. In this position the face 90 of the stop member 104 is clear of the forward path of the block 33. The serrated face 98 of the stop member 96 is pushed into the downward LOCK position designated on the cover 141. In this position the face 97 of the stop member 96 is in contact with the block 61, preventing forward motion of the ram 46. The arm 65, via the handle 68, may be moved back and forth in the zone designated REV on the cover 141 to generate a revving sound as prelude to launching the toy vehicle in the chamber 24. Referring to FIG. 7*a*, the revving sound is engendered by vibration of the strip 136 by the arcuate projection 132 on the rotating plastic disk, and by abrasion of the strip 136 by the rough circumferential surface of the rotating metal disk. Referring to FIGS. 1, 3, 4, 5 and 8, to launch the toy vehicle in the chamber 24 the arm 65, via the handle 68, is pushed forward to the FIRE zone on the cover 141. In this position, the arm 65 pushes the release member 86 forward, lifting the first and second arms 87 and 88 from, respectively, the upper surfaces 64 and 63 of, respectively, the first and second rams 46 and 56, clearing the forward paths of, respectively, the projections 93 and 94. The second ram 56 is shot forward by a spring 85, through the opening 57, into the chamber 24, pushing the toy vehicle out of the chamber 24, through the opening 111 in the first wall 39, and down the ramp 112. To launch a toy vehicle in the chamber 25 the arm 65, via the handle 68, is moved rearward, drawing back the second ram 56, and permitting the arms 87 and 88 of the release member 86 to descend, blocking the paths of, respectively, the projections 93 and 94. The serrated face 98 of the stop member 96 is pushed to the FIRE position designated on the cover 141. In this position, the face 97 of the stop member 96 is clear of the forward path of the block 61. The stop member 104 may be pushed to the LOCK position designated on the cover 141 or left in the FIRE position, depending upon whether the ram 56 is desired to be shot forward with the ram 46. The arm 65, via the handle 68, may be drawn back and forth in the zone designated REV on the cover 141 as prelude to the launching of the toy vehicle in the chamber 25. To launch the toy vehicle in the chamber 25, the arm 65, via the handle 68, is moved forward to the zone designated FIRE on the cover 141, pushing the release member 86 forward, lifting the arms 87 and 88, permitting the spring 74 to shoot the ram 46 forward into the chamber 25. As indicated, the ram 56 may or may not be simultaneously shot forward, depending upon whether the stop member 104 was in, respectively, the FIRE or LOCK position designated on the cover 141.

Referring to FIGS. 1, 3, and 8, if the toy vehicle in the chamber 25 is desired to be launched and not the toy vehicle in the chamber 24, the procedure is analogous. The arm 65, via the handle 68, is drawn backward, and the serrated face 98 of the stop member 96 is pushed to the FIRE position designated on the cover 141. The serrated face 99 of the stop member 104 is pushed to the LOCK position designated on the cover 141. The arm 65, via the handle 68, may be drawn back and forth in the zone designated REV on the cover 141 to generate a revving sound as prelude to the launch of the toy vehicle in the chamber 25. The arm 65, via the handle 68, is moved forward to the zone designated FIRE on the cover 141. Referring to FIG. 6, the ram 46 is shot forward into the chamber 25, launching the toy vehicle 110 therein out the opening 111 in the first wall 39 and down the ramp 112.

Referring to FIGS. 1, 4, and 8, the toy vehicle in the chamber 24 may then be launched by drawing back the handle 68 and pushing the serrated face 99 of the stop member 104 to the position designated FIRE on the cover 141. With or without preliminary reciprocating motion of the handle 68 to generate a revving sound, the handle 68 is moved forward to the position designated FIRE on the cover 141, resulting in the ram 56 being shot forward, launching the toy vehicle in the chamber 24.

Referring to FIGS. 1, 3, and 8, to simultaneously launch the toy vehicles in the chambers 24 and 25, the arm 65, via the handle 68, is drawn backward, and the serrated faces 98 and 99 of, respectively, the stop members 96 and 104 are pushed to the FIRE positions designated on the cover 141. With or without preliminary reciprocating motion of the handle 68 in the REV zone of the cover 141 to engender a revving sound, the handle 68 is moved forward to the position designated FIRE on the cover 141. The rams 46 and 56 shoot forward, launching the toy vehicles from, respectively, the chambers 25 and 24.

Referring to FIGS. 1, 3, and 8, in general, to launch a toy vehicle in a given chamber the arm 65, via the handle 68, is moved rearward, withdrawing the rams 46 and 56 so that the arms 87 and 88 of the release member 86 are interposed before, respectively, the projections 93 and 94 on, respectively, the first and second rams 46 and 56. The hexagonal magazine 15 is rotated until the desired chamber occupies the lowermost horizontal position in the hexagonal magazine 15. This position is indicated by the alignment of the corresponding marks 160 and 161 with, respectively, the marks 162 and 163 on the top of the second wall 49, and the snapping of the projection 27 into the receptacle 29 of the receiving member 26. The serrated face of the corresponding stop member is pushed to the FIRE position designated on the cover 141. The serrated face of the other stop member is pushed either to the position designated LOCK or to the position designated FIRE on the cover 141, depending upon, respectively, whether the other ram is desired to be held, or also to be shot forward. The arm 65, via the handle 68, is pushed forward to the position designated FIRE on the cover 141, lifting the arms 87 and 88 of the release member 86 above the projections 93 and 94. The corresponding ram is shot forward into the selected chamber, launching the toy vehicle therefrom. Toy vehicles in both horizontal lowermost chambers may, of course, be simultaneously launched in this fashion.

Referring to FIGS. 3 and 8, an opening 153 in the cover 141 and an opening 156 in the frame 30 are configured to form a handle for carrying the present invention. In the carrying position, the longitudinal axis 113 of the frame 30 assumes a substantially vertical orientation with the handle on top. A hexagonal piece of cardboard may be disposed between the hexagonal magazine 15 and the first wall 39 to retain toy vehicles in the chambers while the present invention is carried.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An apparatus for launching objects, comprising:

a frame;

a magazine, removably disposed on said frame, having a plurality of chambers therein, each of said chambers having a first opening therein communicating with a second opening therein;

a first ram, disposed on said frame, movable between a first and a second position, said first ram being clear of said magazine in said first position;

a second ram, disposed on said frame, movable between a third and a fourth position, said second ram being clear of said magazine in said third position, said magazine being positionable on said frame to simultaneously align a first and a second of said chambers with, respectively, said first and second rams so that said first ram in moving from said first to said second position passes into said first chamber through said first opening thereof, and said second ram in moving from said third to said fourth position passes into said second chamber through said first opening thereof;

an arm, pivotally disposed on said frame, movable between a fifth and a sixth position;

means, coupled to said arm, for transmitting motion of said arm to said first and second rams so that movement of said arm from said sixth to said fifth position engenders movement of said first ram from said second to said first position, and movement of said second ram from said fourth to said third position, and so that movement of said arm from said fifth position to said sixth position does not engender movement of said first and second rams;

means, affixed to said frame and said first ram, for urging said first ram from said first position to said second position;

means, affixed to said frame and said second ram, for urging said second ram from said third position to said fourth position;

means, disposed on said frame, for selectively fixing and releasing said first ram in said first position;

means, disposed on said frame, for selectively fixing and releasing said second ram in said third position; and, means, disposed on said frame and on said first and second rams, for fixing said first and second rams in, respectively, said first and third positions, and for releasing said first and second rams in, respectively, said first and third positions upon movement of said arm to a predetermined position.

2. An apparatus as in claim 1 further comprising means, coupled to said arm, for generating, in response to movement of said arm, a revving sound.

3. An apparatus as in claim 2 wherein said revving sound generating means comprises:

a disk, rotatably disposed on said frame, having a circumferential surface, and having a rough region and a projection on said circumferential surface;

a flexible strip, affixed to said frame, and flexed against said circumferential surface; and, means, disposed on said frame, coupled to said arm and said disk, for tranmitting motion of said arm to said disk so that movement of said arm from said fifth position to said sixth position engenders rotation of said disk, and movement of said arm from said sixth position to said fifth position does not affect said disk.

4. An apparatus as in claim 2 wherein said magazine is rotatably disposed on said frame, and configured so that said first and second chambers are simultaneously alignable with, respectively, said first and second rams by rotation of said magazine.

5. An apparatus as in claim 4 further comprising a clip, coupled to said first chamber, having an arched portion disposed in said first chamber for pressing said objects against a wall of said first chamber.

6. An apparatus as in claim 5 further comprising means, disposed on said frame, operative when said first and second rams are in, respectively, said first and third positions, for automatically fixing said first and second rams in, respectively, said first and third positions in response to removal of said magazine from said frame, and for automatically releasing said first and second rams, in, respectively, said first and third positions in response to installation of said magazine on said frame.

7. An apparatus as in claim 6 further comprising means, disposed on said magazine and said frame, for visually aligning said first and second chambers with, respectively, said first and second rams.

8. An apparatus as in claim 7 further comprising means, disposed on said magazine and said frame, for securing said first and second chambers in alignment with, respectively, said first and second rams.

9. An apparatus as in claim 1 further comprising a clip, coupled to said first chamber, having an arched portion disposed in said first chamber for pressing said objects against a wall of said chamber.

10. An apparatua as in claim 1 further comprising means, disposed on said frame, operative when said first and second rams are in, respectively, said first and third positions, for automatically fixing said first and second rams in, respectively, said first and third positions in response to removal of said magazine from said frame, and for automatically releasing said first and second rams in, respectively, said first and third positions in response to installation of said magazine on said frame.

11. An apparatus as in claim 10 further comprising a clip, coupled to said first chamber, having an arched portion disposed in said first chamber for pressing said objects against a wall of said first chamber.

12. An apparatus for launching objects, comprising:

a frame;

a magazine, removably disposed on said frame, having a plurality of clambers therein, each of said chambers having a first opening therein communicating with a second opening therein;

a first ram, disposed on said frame, movable between a first and a second position, said first ram being clear of said magazine in said first position;

a second ram, disposed on said frame, movable between a third and a fourth position, said second ram being clear of said magazine in said third position, said magazine being positionable on said frame to simultaneously align a first and a second of said chambers with, respectively, said first and second rams so that said first ram in moving from said first to said secnd position passes into said first chamber through said first opening thereof, and said second ram in moving from said third to said fourth position passes into said second chamber through said first opening thereof;

means, movably disposed on said frame, for moving said first and second rams between, respectively, said first and second position, and said third and fourth position;

means, disposed on said frame, for selectively fixing and releasing said first ram in said first position;

means, disposed on said frame, for selectively fixing and releasing said second ram in said third position; and, means disposed on said frame and on said first and second rams, for fixing said first and second rams in, respectively, said first and third positions, and for releasing said first and second rams in, respectively, said first and third positions upon movement of said moving means to a predetermined position.

13. An apparatus as in claim 12 further comprising a clip, coupled to said first chamber, having an arched portion disposed in said first chamber for pressing said objects against a wall of said chamber.

14. An apparatus as in claim 12 further comprising means, disposed on said frame, operative when said first and second rams are in, respectively, said first and third positions, for automatically fixing said first and second rams in, respectively, said first and third positions in response to removal of said magazine from said frame, and for automatically releasing said first and second rams in, respectively, said first and third positions in response to installation of said magazine on said frame.

15. An apparatus as in claim 14 further comprising a clip, coupled to said first chamber, having an arched portion disposed in said first chamber for pressing said objects against a wall of said first chamber.

16. An apparatus for launching objects, comprising: a frame;

a magazine, removably disposed on said frame, having a chamber therein, said chamber having a first and a second opening therein, said first opening communicating with said second opening;

a ram, disposed on said frame, movable between a first and a second position, said ram being clear of said magazine in said first position, said magazine being positionable on said frame to align said chamber therein with said ram so that said ram in moving from said first to said second position passes into said chamber through said first opening thereof;

an arm, pivotally disposed on said frame, movable between a third and a fourth position;

means, coupled to said arm, for transmitting motion of said arm to said ram so that movement of said arm from said fourth to said third position engenders movement of said ram from said second to said first position, and movement of said arm from said third position to said fourth position does not engender movement of said ram;

means, affixed to said frame and said ram, for urging said ram from said first position to said second position;

means, disposed on said frame and said ram, operative when said ram is in said first position, for fixing said ram in said first position, and for, in response to movement of said arm to a predetermined position, releasing said ram in said first position to move, in response to said urging means, to said second position; and, means disposed on said frome, operative when said ram is in said first position, for automatically fixing said ram in said first position in response to removal of said magazine from said frame, and for automatically releasing said ram in said first position in response to installation of said magazine on said frame.

17. A apparatus as in claim 16 further comprising a clip, disposed in said chamber, having an arched portion for pressing said objects against a wall of said chamber.

* * * * *